United States Patent [19]

Faulconer

[11] Patent Number: 4,690,583

[45] Date of Patent: Sep. 1, 1987

[54] FLAT FOLDING ALTERNATING BARRIER

[76] Inventor: Harry A. Faulconer, 10405 Sierra Vista, La Mesa, Calif. 92041

[21] Appl. No.: 849,539

[22] Filed: Apr. 8, 1986

[51] Int. Cl.[4] ..... E01F 13/00

[52] U.S. Cl. ..... 404/6; 404/12

[58] Field of Search ..... 404/1, 6, 9, 12, 13, 404/40, 43; 256/1, 13.1; 52/7, 64, 71, 174; 49/49; 108/112; 14/69.5

[56] References Cited

U.S. PATENT DOCUMENTS

| | | | |
|---|---|---|---|
| 2,841,831 | 7/1958 | Mackintosh | 52/7 |
| 3,091,816 | 6/1963 | Wetzel | 108/112 |
| 4,004,857 | 1/1977 | Eschen, Jr. | 404/6 |
| 4,084,713 | 4/1978 | Rohrs et al. | 14/69.5 X |
| 4,274,172 | 6/1981 | Franklin | 14/69.5 |
| 4,632,598 | 12/1986 | Richards | 404/6 |

*Primary Examiner*—Stephen J. Novosad
*Assistant Examiner*—Matthew Smith
*Attorney, Agent, or Firm*—Lewis Anten

[57] ABSTRACT

A traffic barrier is movable to vary the number of lanes available for vehicles and is sufficiently sturdy to withstand collisions from vehicles and direct them back into the flow of traffic rather than permitting hazardous crossovers, which often result in head-on collisions. A plurality of panels are configured to be positioned in a side by side array between two roadway sections so that their lengths are generally parallel to the roadway. The panels are preferably connected by a plurality of hinges arranged for hingedly connecting adjacent barrier panels together. A first barrier is erected by hinging a pair of the panels toward one another on a first side of the roadway and providing a traffic lane over the array on a second side of the roadway. The first barrier may be removed and a second barrier on the second side of the roadway and a traffic lane over the array on the first side of the roadway may be formed by elevating a second pair of the barriers panels.

31 Claims, 16 Drawing Figures

FLAT FOLDING ALTERNATING BARRIER

BACKGROUND OF THE INVENTION

This invention relates generally to highway traffic control systems and particularly to barriers for forming traffic lane dividers. Still more particularly, this invention relates to a movable traffic lane barrier to make available traffic lanes in greater number according to the direction of heaviest traffic flow.

It is conventional practice to use road dividers during peak traffic hours to increase the number of lanes available in the direction of heavier traffic and to reduce the number of lanes for vehicles moving in the opposite direction.

Some highways use barriers that are manually positioned to control the number of lanes available to traffic flowing in each direction on a highway. These manually placed barriers are often used on bridges. Manually positioned barriers are easily displaced by even minor collisions with vehicles and have no capability of preventing traffic from crossing over into the path of oncoming traffic.

There have been several devices constructed to provide barriers that are mechanically movable, but these previous devices fail to prevent crossovers and none known to have gained acceptance for use on public highways.

SUMMARY OF THE INVENTION

This invention provides an improved movable barrier for controlling traffic flow on a highway. The traffic barrier according to the present invention is easily movable to vary the number of lanes available for vehicles and is sufficiently sturdy to withstand collisions from vehicles and direct them back into the flow of traffic rather than permitting hazardous crossovers, which often result in head-on collisions.

A movable divider according to the invention for selectively dividing a roadway may comprise a plurality of barrier panels configured to be positioned in a side by side array between two roadway sections so that their lengths are generally parallel to the roadway. The panels are preferably connected by a plurality of hinges arranged for hingedly connecting adjacent barrier panels together. The invention further includes means for selectively elevating a first one of the hinges and the panels connected thereto to erect a first barrier adjacent a first side of the roadway and providing a traffic lane over the array adjacent a second side of the roadway. The invention further includes means for selectively elevating a second one of the hinges and the panels connected thereto to remove the first barrier and to erect a second barrier adjacent the second side of the roadway and providing a traffic lane over the array adjacent the first side of the roadway.

The movable divider according to the invention preferably has a pair of the barrier panels hingedly mounted to the roadway. The hinges preferably have locked positions to provide rigidity to the barriers and have an unlocked position for each barrier panel to permit removal thereof from the array.

The movable divider according to the present invention preferably comprises means, such as a hydraulic jack, placed under the barrier panel for lifting the hinges to elevate the barrier panels to erect the barriers. The movable divider according to the invention also preferably further comprises actuator means, such as hydraulic ram, connected between the roadway and the array of barrier panels for selectively moving the array laterally with respect to the roadway to erect one of the first and second barriers and remove the other barrier.

The movable divider according to the present invention may also further comprise support beam means depending from selected hinges to provide vertical support to the array of barrier panels. The support beam preferably includes a flange that rests upon a support to support the horizontal panels. A support beam preferably hangs between the pair of panels that are elevated to form the barrier with the support beam flange being disposed generally parallel to the roadway and between the elevated, hinged ribs to provide additional rigidity to the barrier.

The method of the invention for selectively dividing a roadway may comprise the steps of placing a plurality of barrier panels between a pair of roadway sections; connecting adjacent barrier panels hingedly together; selectively elevating adjacent sides of a first pair of the barrier panels to form a first barrier adjacent a first side of the roadway and to provide a traffic lane adjacent a second side of the roadway; and selectively elevating adjacent sides of a second pair of the barrier panels to form a second barrier and to remove the first barrier, the second barrier being adjacent the second side of the roadway and to provide a traffic lane over the array adjacent the first side of the roadway.

DESCRIPTION OF THE PREFERRED EMBODIMENT

Figure 1:
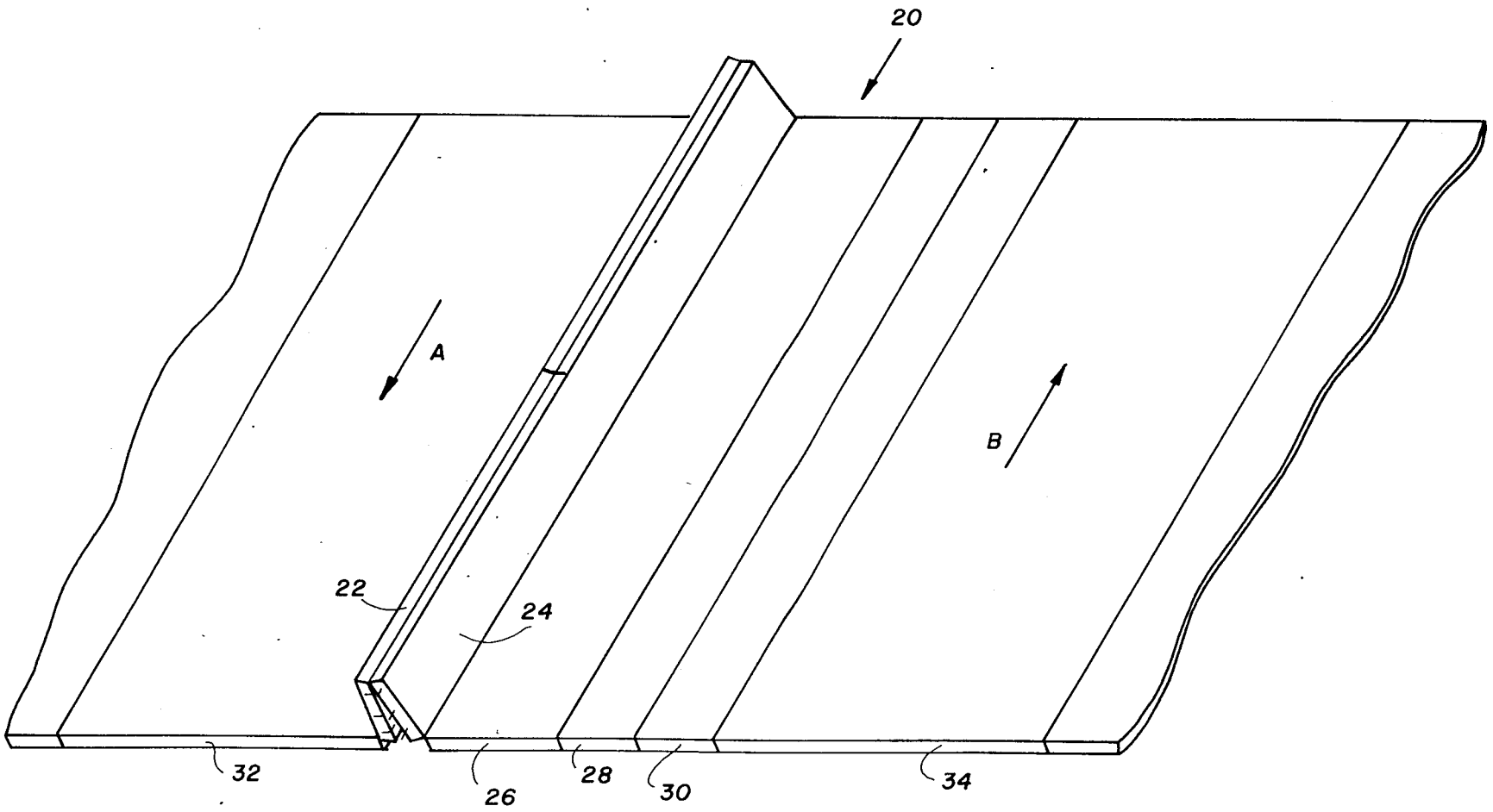
FIG. 1 is an isometric view of a movable traffic barrier section according to the invention.

Referring to FIG. 1, a movable traffic barrier section 20 includes a plurality of barrier panels 22, 24, 28 and 30 mounted between a pair of fixed roadway portions 32 and 34 of a roadway 36. A movable roadway panel 26 is located between the barrier panels 24 and 28. As shown in FIG. 1, the movable traffic barrier section 20 divides the roadway 36 into three lanes. A lane 38 carries traffic in the direction of the arrow A, and a pair of lanes 40 and 42 carry traffic in the direction of the arrow B. The invention is not restricted to use in a highway having any particular number of lanes. The lanes 38, 40 and 42 are merely exemplary for purposes of explaining the structure and method of operation of the movable traffic barrier section 20.

Figure 2:
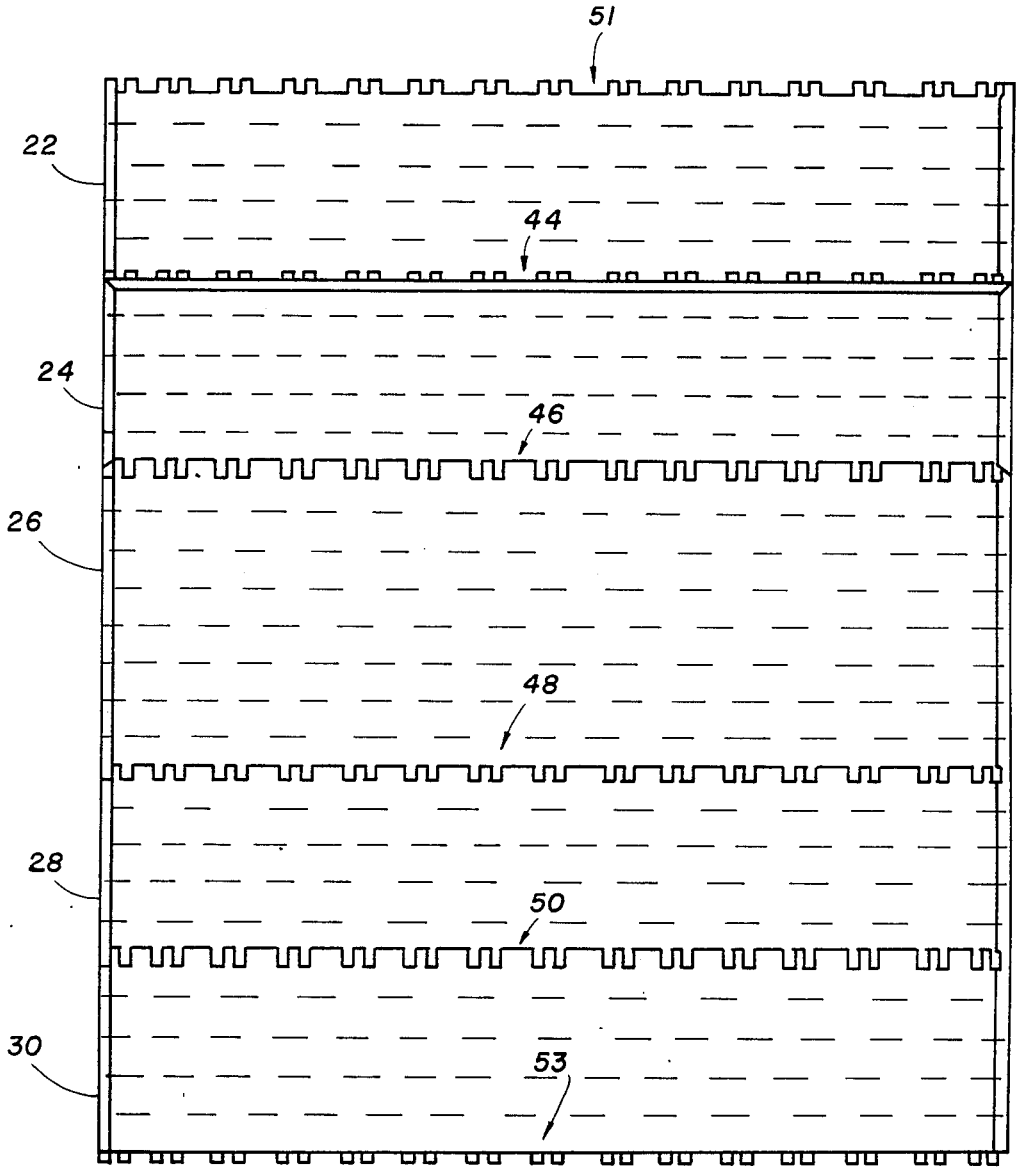
FIG. 2 is a plan view of the movable traffic barrier section of FIG. 1.
Figure 3:
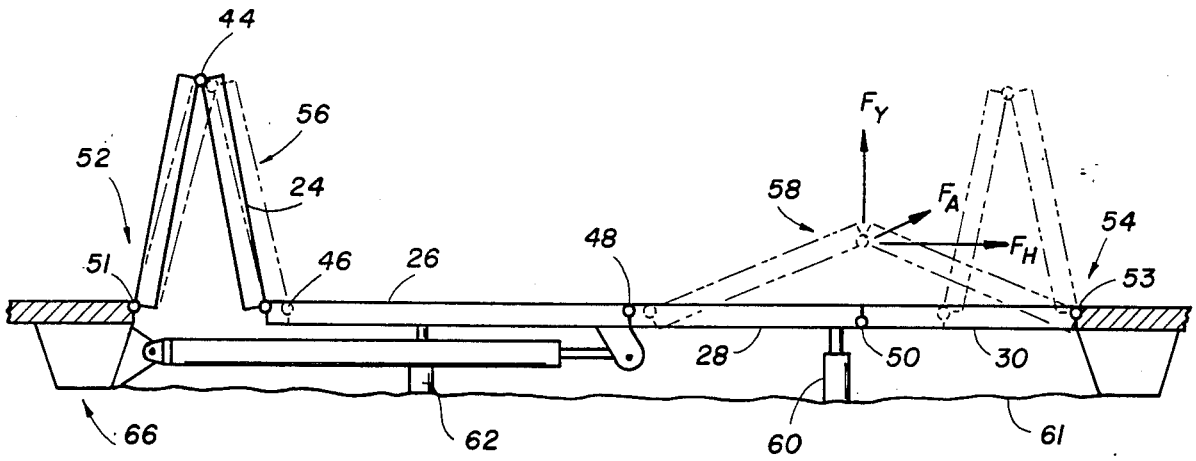
FIG. 3 is an elevational view of the movable traffic barrier section of FIG. 1.
Figure 4:
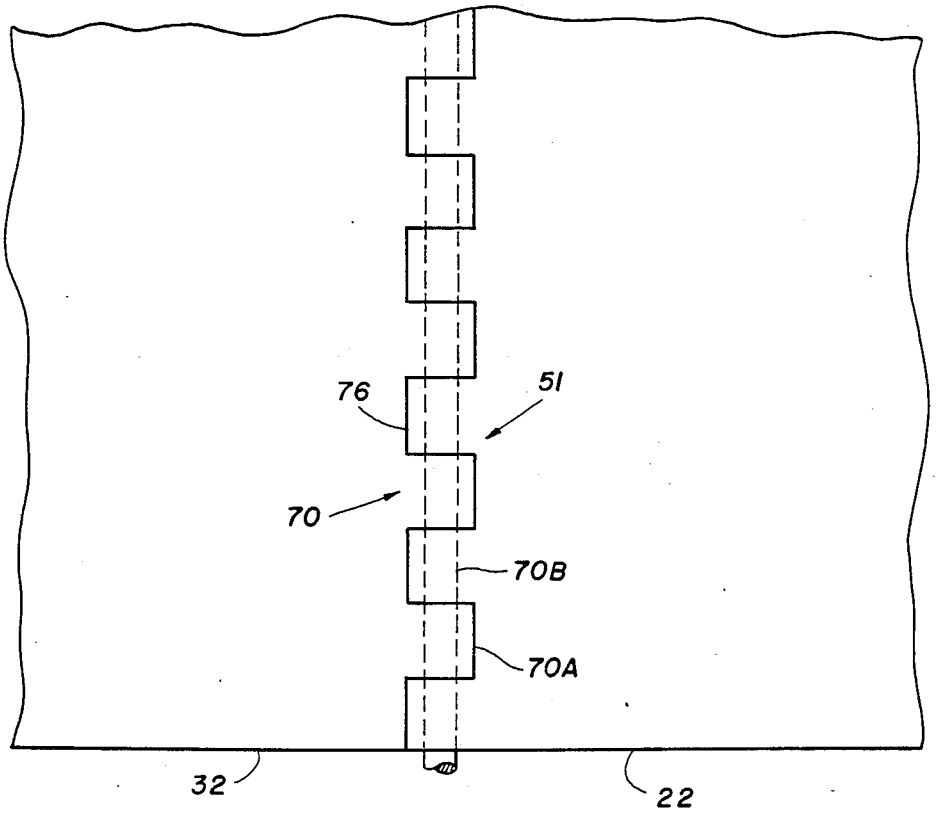
FIG. 4 is a plan view of a portion of a barrier panel of the movable traffic barrier of FIGS. 1–3 showing the barrier panel hingedly connected to a fixed roadway.
Figure 5A:
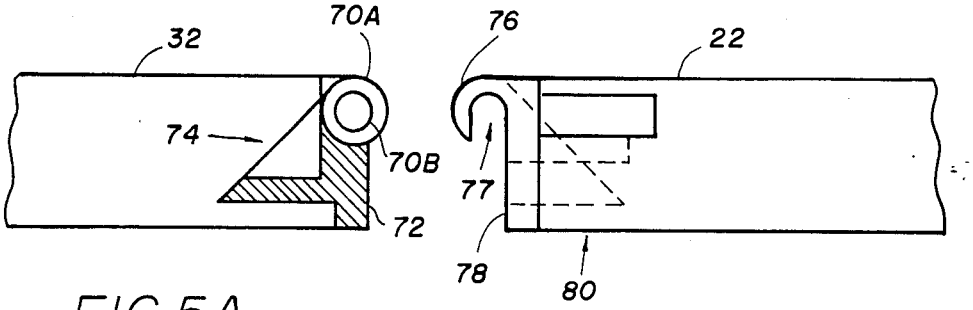
FIGS. 5A and 5B are elevational views of the hinged connection between the barrier panel and roadway of FIG. 4.
Figure 5B:
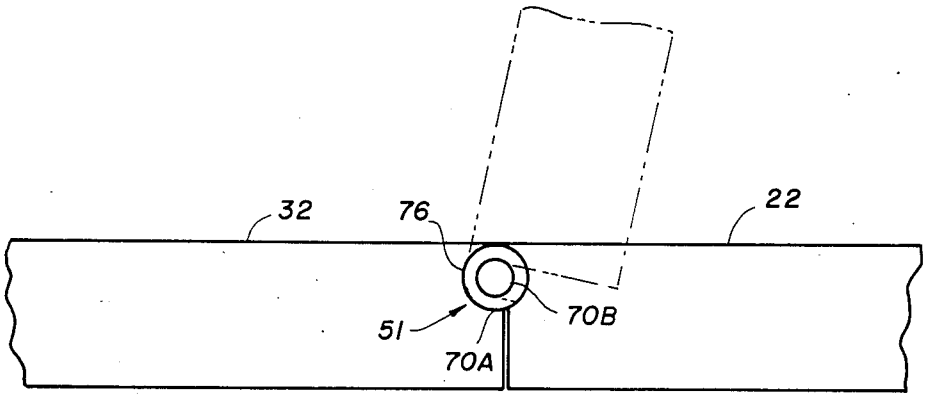

Referring to FIGS. 1–3, the panels 22, 24, 26, 28 and 30 are hingedly connected together. A hinge 50 connects the barrier panel 22 to one side of the barrier panel 24, and a hinge 48 connects the other side of the barrier panel 24 to one side of the roadway panel 26. A hinge 46 connects the other side of the roadway panel 26 to one side of the barrier panel 28, and a hinge 44 connects the other side of the barrier panel 28 to the barrier panel 30. As shown in FIG. 3, a hinge 53 connects a side 52 of the barrier panel 22 to the roadway portion 32, and a hinge 51 connects a side 54 of the barrier panel 30 to the roadway portion 34. The structure of the hinges 51 and 53 is shown in FIGS. 4, 5A and 5B, which are described in detail subsequently.

Referring still to FIGS. 1–3, the movable traffic barrier section 20 is shown with the panels 26, 28 and 30 lying horizontal to be substantially coplanar with the roadway portions 32 and 34. The barrier panels 22 and 24 are in elevated positions to form a barrier 56. The elevated barrier panels 22 and 24 preferably make obtuse angles with the adjacent roadway portion 32 and roadway panel 26, respectively. The obtuse angle between the roadway portion 32 and the barrier panel 22, for example, may be selected such that if a vehicle (not shown) traveling in the lanes 38 or 40 collides with the barrier 56, ordinarily the only portion of the vehicle that contacts the barrier 56 is the front tire of the vehicle. The vehicle will ordinarily be deflected back into its original lane of travel after the tire collides with the barrier 56.

Referring to FIG. 3, a jack 60 may be positioned between the roadway subsurface 61 and the panel 28 near the hinge 44. The jack 60 may be of any suitable design, but it is preferably a hydraulic jack actuated by pressurized fluid from a reservoir (not shown), such as an accumulator connected to a compressor (not shown). A jack 62 similar to the jack 60 is mounted to the subsurface 61 such that the jack 62 will be adjacent the hinge 50 between the barrier panels 22 and 24 when they are in their lowered positions. An actuator 64, which preferably comprises a hydraulic ram, is connected between a first bracket 66 mounted to the roadway portion 32 and a second bracket 68 mounted to the underside of the roadway panel 26. The actuator 64 may alternatively be connected between the roadway portion 34 and the roadway panel 26. The actuator 64 may comprise an electric motor, a pneumatic actuator, or any other means suitable for providing a force for moving the barrier section 20.

In order to move the panels 22, 24, 26, 28, and 30 to increase the number of lanes in the direction of the arrow B of FIG. 1 and decrease the number of lanes in the direction of arrow A, it is necessary to elevate the hinge 44 between the barrier panels 28 and 30 a short distance h, shown in FIG. 3. Elevating the hinge 44 with the jack 60 also lowers the hinge 50 a corresponding distance. The actuator 64 then forces the bracket 68 to the right as viewed in FIG. 3. The force of the actuator 64 is transmitted through the barrier panel 28 to the hinge 44. The force of the actuator is denoted $F_A$ and is collinear with the line between the hinges 46 and 44. Referring to the phantom representations in FIG. 3 of barrier panels 28 and 30 and the hinge 44, which are slightly elevated above the plane of the roadway 36, the force $F_A$ has a horizontal component $F_H$ and a vertical component $F_V$. The jack 60 lifts the hinge 44 a distance such that the vertical component $F_V$ is sufficient to move the barrier panels 28 and 30 to the fully upward position indicated by the arrow C in FIG. 3, thereby forming a barrier 58.

It should be noted that the actuator 64 does not have to lift the entire weight of the barrier panels 28 and 30 in order to shift the barrier. After the actuator 64 starts to move the bracket 68 to the right, the combined weight of the barrier panels 22 and 24 aid in elevating the barrier panels 28 and 30. The weight of the barrier panel 22 exerts a downward force component on the hinge 44, which, with a component of the weight of the barrier panel 24, bears upon the hinge 48. The force that the barrier panels 22 and 24 exert on the hinge 48 has a component directed through the roadway panel 26 parallel to the force of the actuator 64. If the movable traffic barrier section 20 did not include the actuator 64 and the jacks 60 and 62, equilibrium of the panels 22, 24, 26, 28 and 30 would exist with both of the hinges 44 and 50 between the lowered and elevated positions. The exact heights of the hinges 44 and 50, at equilibrium depends upon the widths of the barrier panels 22, 24, 28 and 30 and the width of the movable roadway portion 26. Therefore, after an initial upward movement of the hinge 44 by the jack 60, the weight of the barrier panels 22 and 24 will move the barrier panels 28 and 30 to their equilibrium positions. The actuator 64 then supplies a force sufficient to move the barrier panels 28 and 30 the remainder of the distance to the elevated position. Even after the barrier panels 28 and 30 are lifted beyond the equilibrium position, the force of the actuator 64 is primarily used to overcome friction in the hinges and a barrier panel transport mechanism 65, which is described subsequently with reference to FIGS. 7A and 7B.

Referring to FIGS. 4, 5A and 5B, the hinge 53 is shown in detail. A solid bar 70 is mounted in the roadway portion 32 parallel to the edge of the barrier panel 22. As best shown in FIG. 5A, an anchor 72 is fixed in an edge 74 of the roadway portion 32. The anchor 72 is preferably formed of steel or material of similar strength. The bar 70 preferably has alternating diameter sections 70A and 70B with the diameter of the sections 70A being larger than the diameter of the sections 70B. A plurality of fingers 76 project from an anchor 78 mounted in an edge 80 of the barrier panel 22, which is preferably formed of prestressed concrete. The fingers 76 curve to form a void 77 so that the fingers 76 fit upon the smaller diameter sections 70B of the rod 70 between the larger diameter portions 70A. Thus, as shown in FIG. 5B, the barrier panel 22 is rotatable about the hinge 44 relative to the roadway portion 32 between the horizontal position shown in FIG. 5A and the elevated position shown in FIG. 1 and the phantom lines of FIG. 5B.

Figure 6:
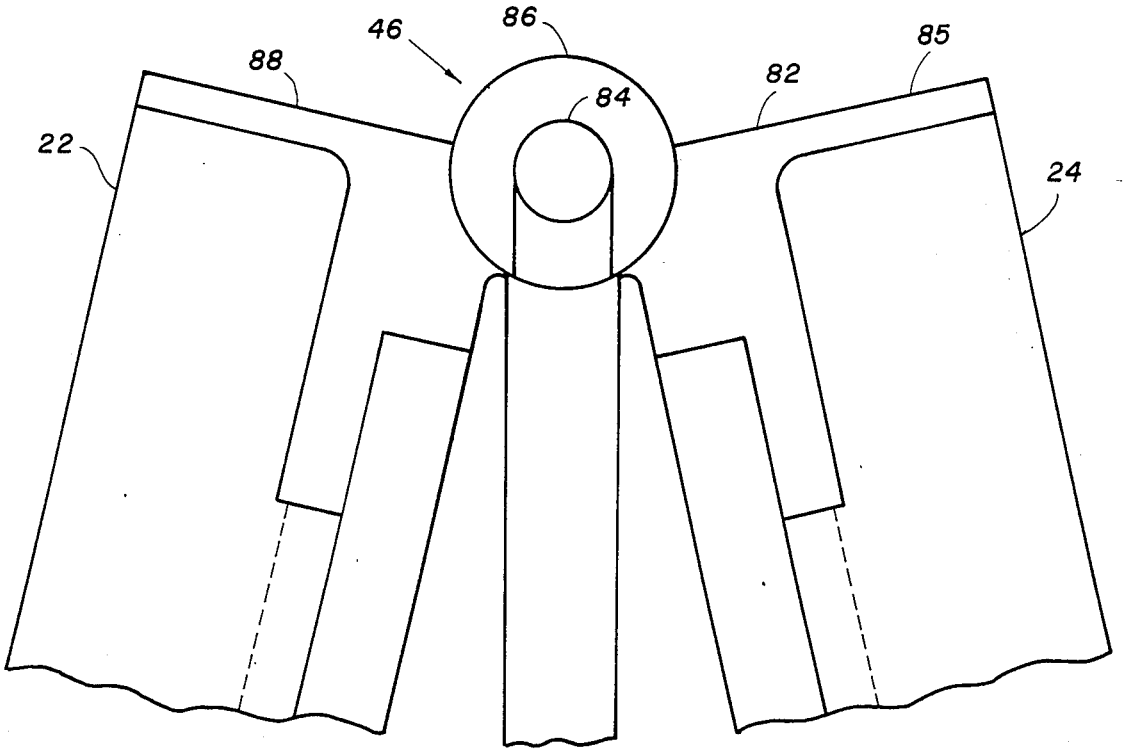
FIG. 6 is an elevational view of a hinged connection between two barrier panels in the movable traffic barrier of FIGS. 1–3 and showing a support beam supported by the common hinge between the barrier panels.
Figure 9:
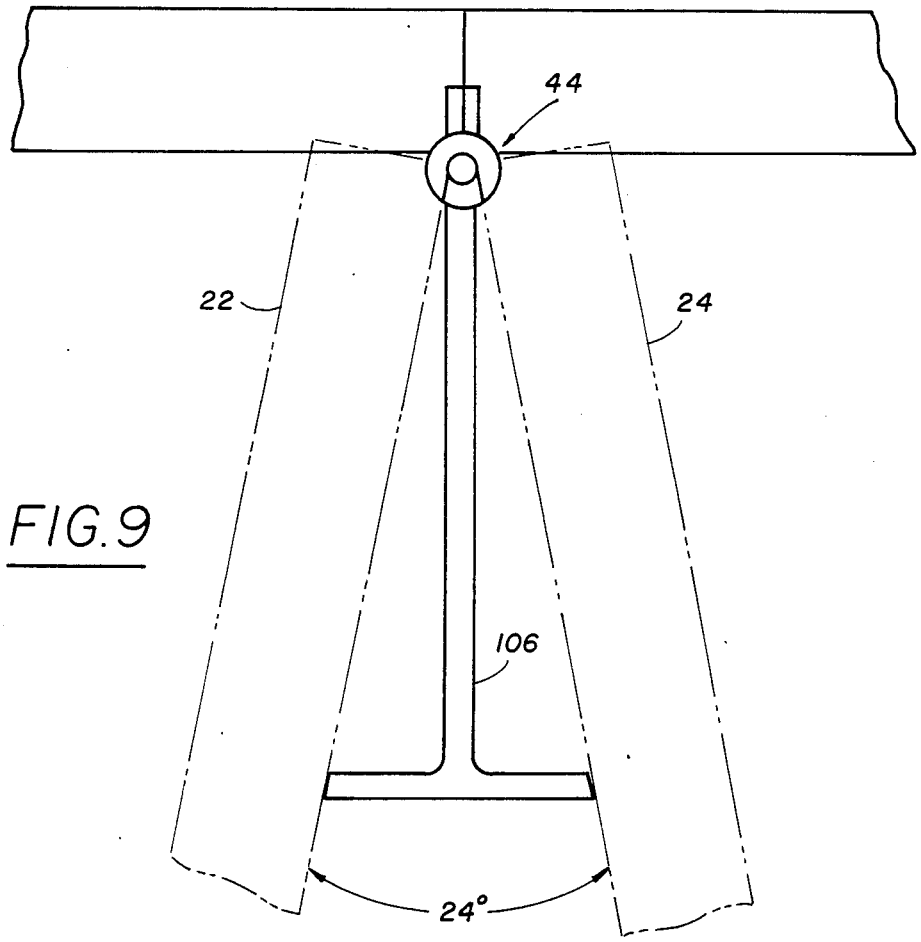
FIG. 9 is an elevation view of a support beam, hinge and adjacent barrier panels of FIGS. 3 and 6 showing centering tabs for locking the support beam in a vertical position when the barrier panels connected thereto are in the flat roadway position.

Referring to FIGS. 6 and 9, the hinge 50 between the barrier panels 22 and 24 is shown in detail. The hinge 50 is similar to the hinge 53 described above except that the hinge 50 is attached adjacent the lower surfaces of the barrier panels 22 and 24, whereas the hinge 53 is attached adjacent the upper surfaces of the barrier panel 22 and the roadway portion 32. An anchor 82 mounted in the barrier panel 24 holds a rod 84 parallel to an end face 85 of the panel 24. The rod 84 is preferably substantially identical to the rod 70. A plurality of fingers 86 extend from an anchor 88 mounted in the barrier panel 22 to engage the rod 84. The fingers 86 form voids (not shown) similar to the voids in fingers 76 so that the fingers 86 and the rod 84 may interlock to form the hinge 50.

A support beam 106 hangs from the rod 84, and a centering tab 107 projects upward from the support beam 106 between the panels 22 and 24. When the panels 22 and 24 are parallel with the roadway, they impinge on the centering tab 107 and lock the support beam 106 in a vertical position.

Figure 12:
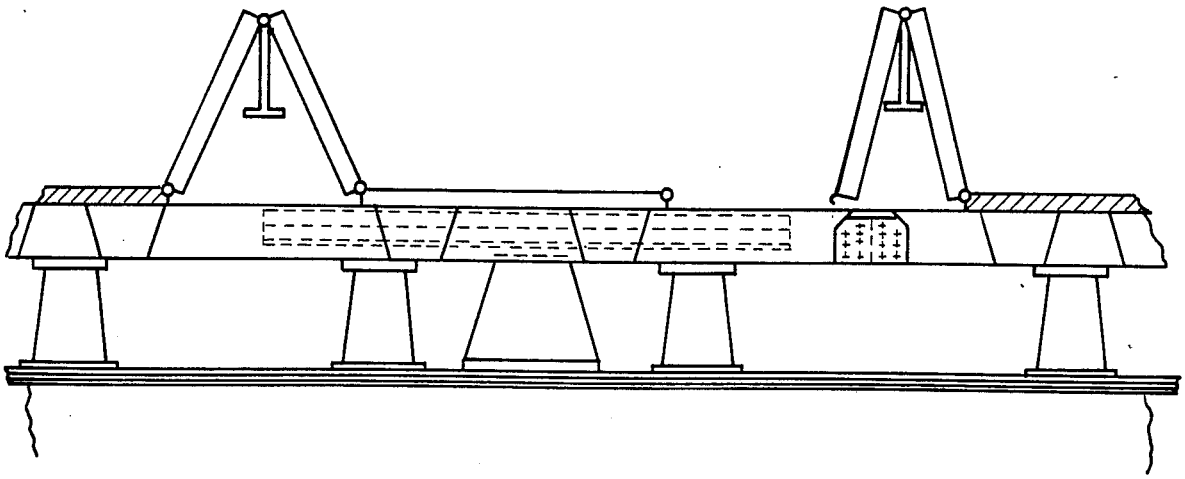
FIG. 12 is a cross sectional view showing both of a pair of barriers partially elevated with a panel removed from one barrier and a rod for supporting the other panel in the barrier.

Referring to FIGS. 5A, 5B 6 and 12, the fingers 76 and 86 engage the rods 70 and 84, respectively, so that when the barrier panel 22 is parallel to the surface of the roadway 36, the fingers are disengagable from the rods so that the barrier panel 22 may be lifted vertically. When the barrier panels 22 and 24 are in their elevated positions, the fingers 76 and 86 cannot be removed from their respective rods 70 and 84. Thus, a section of the movable traffic barrier section 20 may be removed for replacement and repairs to either the movable traffic barrier section 20 or any of the underlying structures. FIG. 12 shows the barrier panel 28 removed from the barrier section 20. A rod 99 replaces the barrier panel to prevent the barrier panel 30 from falling. For example, as shown in FIG. 12, sections of the barrier assembly may be replaced or repaired while both barriers 56 and 58 are partially erected. Providing the capability of selectively having a center lane between the barriers 56 and 58 permits much of the necessary maintenance and repair work to be done without stopping traffic flow while affording protection to workers.

When the barrier panels 22 and 24 are in their elevated positions as shown in FIGS. 1 and 3, they are locked in position so that the barrier 56 is rigid and capable of withstanding impacts from vehicles traveling the roadway without significant damage in many cases. If a barrier panel should become damaged, however, it may be easily replaced.

Figure 7A:
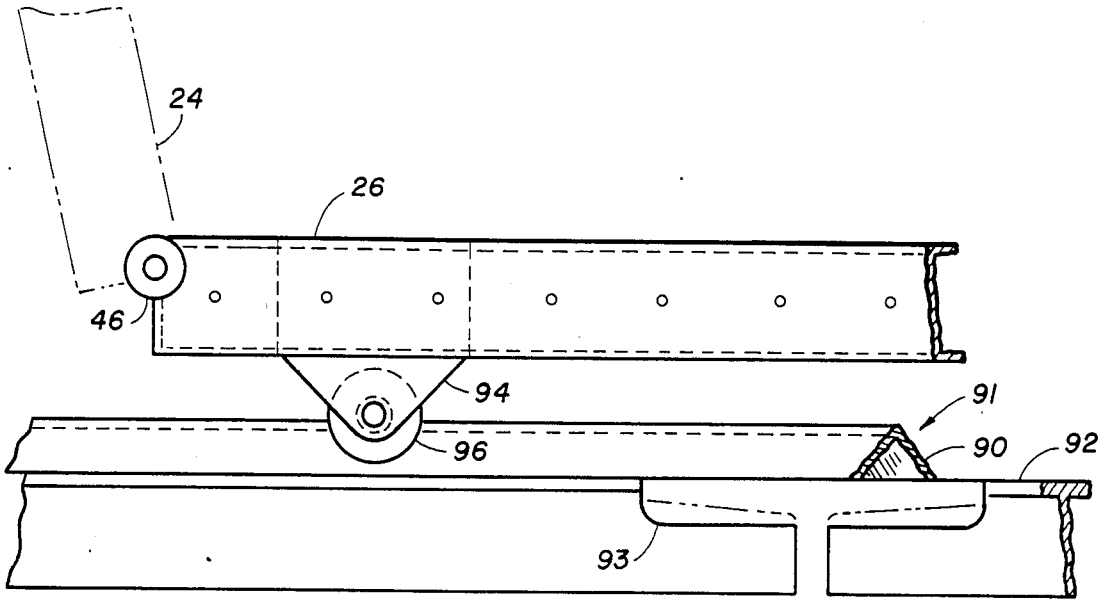
FIG. 7A is an elevational view of a transporter system for facilitating lateral movement of the sections of the movable traffic barrier of FIGS. 1–3.
Figure 7B:
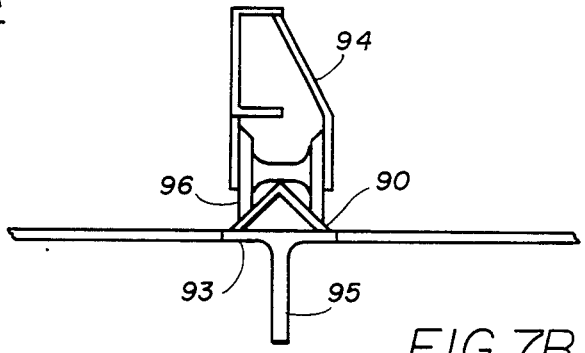
FIG. 7B is a cross sectional view of the transporter wheel and track of FIG. 7A.

Referring to FIGS. 7A and 7B, the roadway panel 26 and the barrier panels 22, 24, 28 and 30 translate horizontally on a system of parallel rails exemplified by a rail 90 placed under the movable traffic barrier section 20. As shown in FIGS. 7A and 7B, a bracket 94 depends from the roadway panel 26 and mounts a roller 96 for rolling movement upon the rail 90. The rail 90 extends transversely to the roadway 36 for a distance equal to the combined width of the folding barrier panels 22 and 24. The movable traffic barrier section 20 should include at least two rails like the rail 90 so that the panels 22, 24, 26, 28, and 30 may be easily moved to control the number of lanes available in each direction. The rail 90 preferably has a generally triangular cross section and has a base 93. An anchor 95 preferably projects downward into the subsurface 61 (shown in FIG. 3) to stabilize the rail 90.

Figure 11:
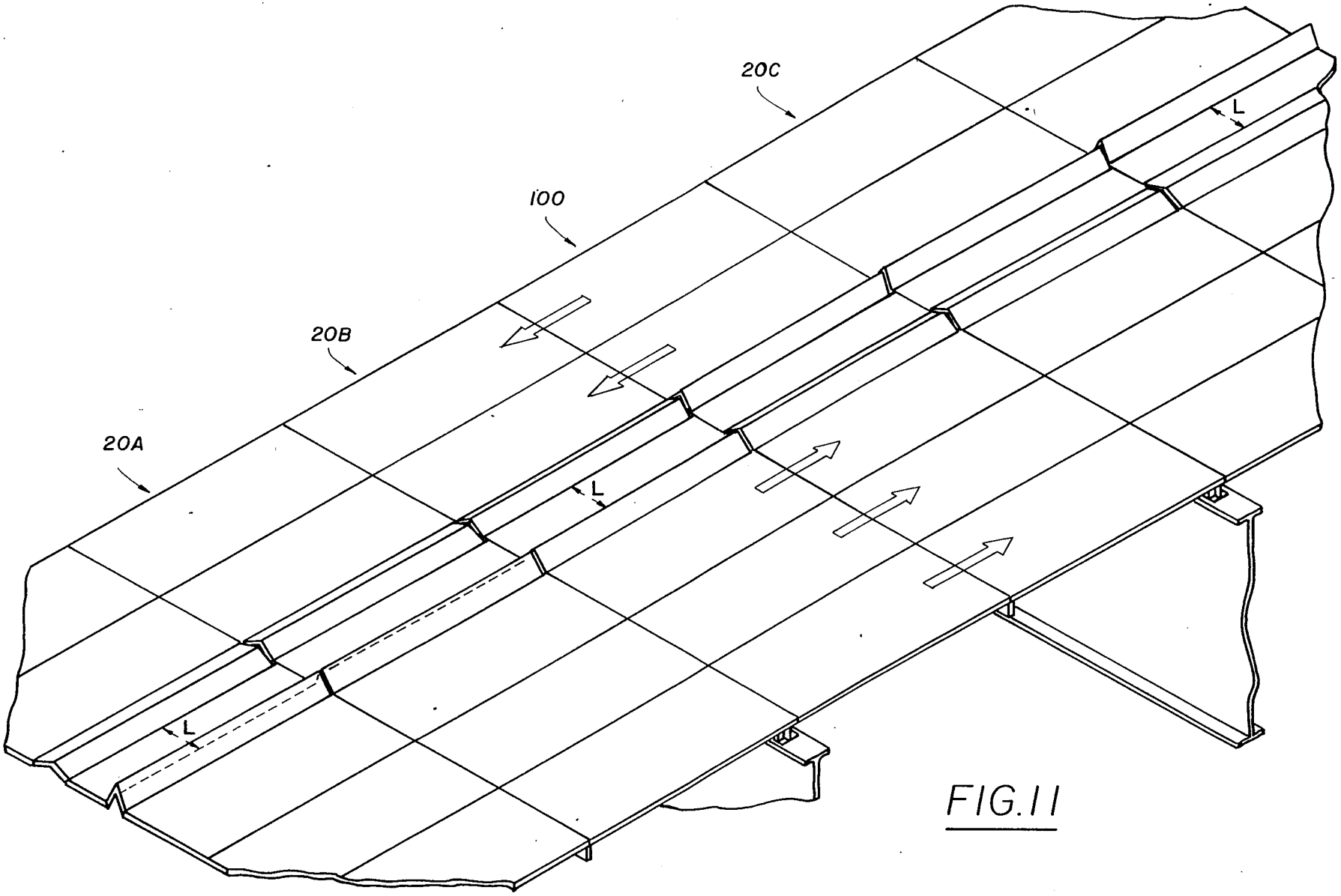
FIG. 11 is an isometric view of a movable traffic barrier system including a multiplicity of barrier sections as shown in FIG. 1 in progressive positions from a partially elevated barrier to to a partially lowered barrier on opposite sides of a lane.

Referring to FIG. 11, a movable traffic barrier system 100 may comprise a multiplicity of movable barrier sections 20A, 20B 20C, etc. arranged end-to-end to provide lane control for any desired distance. Each barrier section in the system 100 preferably is arranged to roll upon at least two rails like the rail 90 described above. Each barrier panel in the movable barrier system 100 preferably includes at least four rollers like the roller 90 to faciliate lateral movement and to provide stability of the panels when they are being moved to change the location of the barrier.

FIG. 11 shows the movable barrier system 100 in transition from one elevated position to another. All of the movable traffic barrier sections may be moved laterally at once to change the location of the barrier, or the barrier sections 20 may be moved sequentially as shown in exaggerated scale in FIG. 11. When the barrier sections are moved sequentially, the effect is a wave of motion of the barrier sections traveling along the length of the roadway. It may be desirable to move the barrier sections 20 sequentially when the barrier system is installed on a bridge. Whether to move the traffic barrier sections 20 sequentially or simultaneously should be determined considering the bridge or highway structure.

Figure 8:
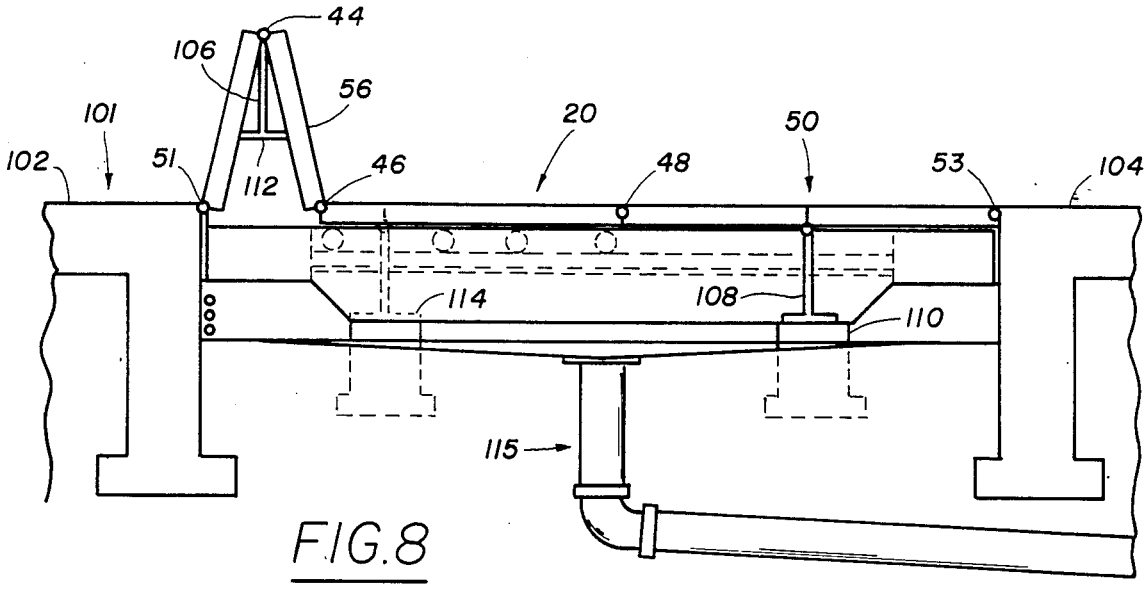
FIG. 8 is a cross sectional view showing the transporter wheels and tracks of FIGS. 7A and 7B and support beams for supporting the barrier panels of FIGS. 1–3.

Referring to FIG. 8, the movable traffic barrier section 20 is shown installed in a typical street or highway 101. The barrier panels 22 and 30 are connected to opposite sides 102 and 104, respectively of the highway 101. It should be noted that the hinges 46, 48, 51 and 53 are adjacent the upper surfaces of the corresponding barrier panels and that the hinges 44 and 50 are adjacent the lower surface of the barrier panels. The location of the hinges permits the barrier panels 22, 24 and 28, 30 to be selectively elevated or lowered in pairs as described above to erect or remove the barriers 56 and 58.

Referring to FIGS. 8 and 9, a support beam 106 may depend from the hinge 50. A support beam 108 may also depend from the hinge 44. As shown in FIG. 8, when the barrier panels 28 and 30 are lowered, the support beam 108 rests upon a support 110 mounted in the earth below the roadway 101. The support beam 106 hangs from the hinge 50 between the barrier panels 22 and 24. The width of a flange 112 at the bottom of the support beam 106 limits the folding motion of the barrier panels 22 and 24 toward one another and further contributes to the rigidity of the barrier formed by elevating the panels 22 and 24. When the barrier panels 22 and 24 are lowered, the support beam 106 moves along an arc so that the flange 112 moves toward a support 114. When the flange 112 rests on the support 114, the support beam 108 hangs between the barrier panels 28 and 30.

As shown in FIG. 8, a drain pipe 115 may be installed below the movable traffic barrier section 20. The drain pipe 115 and the design of the rail 90 and roller 92 prevent obstructions from inhibiting lateral motion of the barrier panels 2, 24, 26, 28 and 30 by draining away small pieces of dirt and rubbish.

Figure 10:
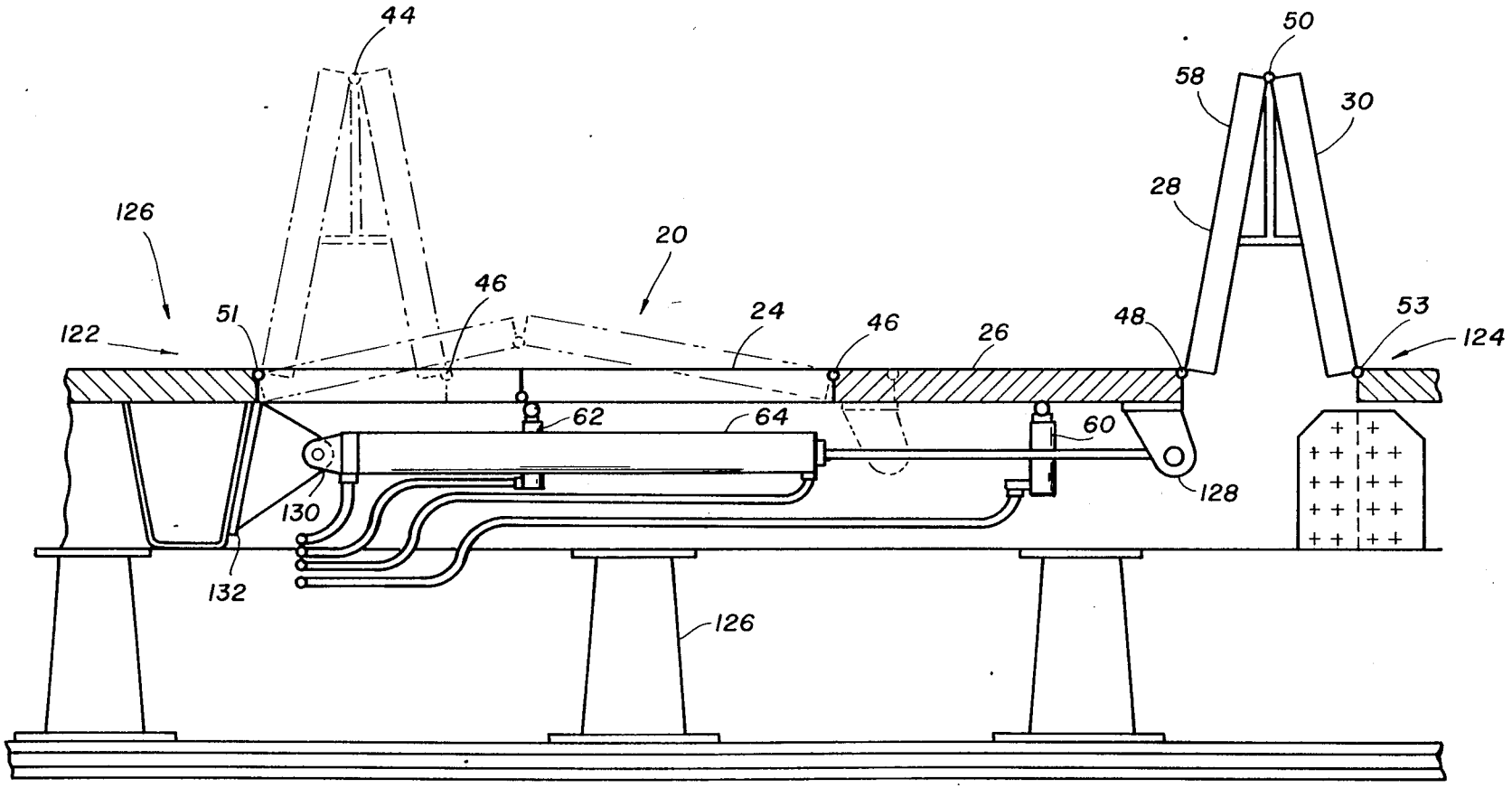
FIG. 10 is a cross sectional view of an embodiment of the invention that is particularly suitable for use on a bridge.

Referring to FIG. 10, the movable traffic barrier section 20 is shown installed on a bridge 120. The barrier panels 22 and 30 are hingedly mounted to opposite sides 122 and 124, respectively of a fixed roadway 126 on the bridge 120. One end 128 of the actuator 64 is connected to the roadway panel 26 as explained previously, and the other end 130 is connected to a deck rib 132 that is a part of the fixed roadway. Many bridges have deck ribs such as the deck rib 132, so it is convenient to attach the actuator to such ribs if they are present in a particular bridge. If the bridge does not have deck ribs, then the end 130 of the actuator 64 may be connected to an anchor (not shown) in the roadway 126. A pair of supports 131 and 133 extend upward from a bridge floor beam 135 to support the support beams 106 and 108, respectively as explained previously with reference to FIG. 8.

The jacks 60 and 62 are conveniently positioned to initiate elevation of the hinges 44 and 50, respectively. It is unnecessary to have the jacks located directly below the corresponding hinges. The jack 62, for example, is shown to be offset slightly from the center of the hinge 50. The only requirement for the jack 62 is that it be capable of lifting the hinge 50 the desired distance to start the barriers 56 and 58 to shift.

The panels 22, 24, 26, 28 and 30 may be any desired width and length. An exemplary embodiment of the movable traffic barrier section 20 is 25 feet long with the roadway panel 26 having a width of 4 feet and the barrier panels 22, 24, 28 and 30 each having a width of 2.5 feet. With these dimensions, the movable traffic barrier section 20 provides a traffic lane that is the width of the roadway panel 26 plus the width of two of the other panels. Thus the traffic lane is 9 feet wide. The barrier formed by elevating the barrier panels 28 and 30 as shown in FIG. 10 is 2.5 feet high and 1.5 feet wide at the base. The thickness of the barrier panels 22, 24, 26, 28 and 30 depends upon the load they are to carry and the desired safety factor to be applied to the load carrying capacity of the movable traffic barrier section 20. Prestressed concrete slabs about three inches thick should be satisfactory for most roadway and bridge applications.

Referring to FIGS. 11 and 12, the barriers 56 and 58 may both be elevated to any desired fraction of their maximum heights to form a center lane between the traffic lanes indicated by the arrows A and B of FIG. 11. The center lane may be any desired width, depending upon the width of the roadway panel between the barriers 56 and 58. The center lane may be used by emergency vehicles or by maintenance vehicles and equipment.

Figure 13:
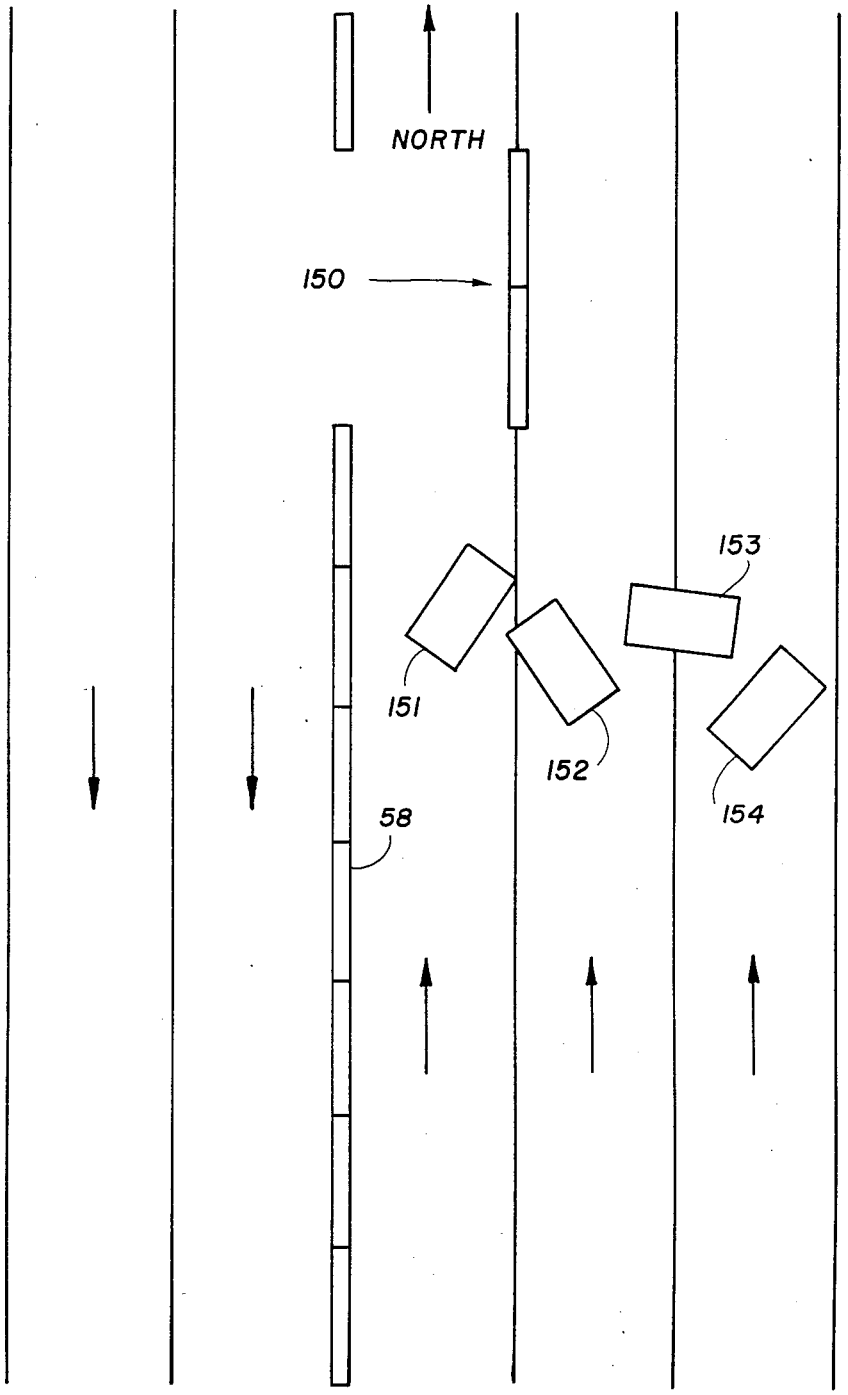
FIG. 13A is a plan view showing a multi-lane roadway and a breach formed by moving two consecutive barrier panel assemblies in the barrier of FIG. 11 to the side of the lane opposite the barrier.

Referring to FIG. 13, the barrier 56 may be breached to provide access to any part of the roadway for emergency vehicles in the event of a traffic accident. The ability to breach the barriers is a significant feature in dealing with accident situations, creating open access for emergency vehicles to a crash scene even if all lanes on the affected side of the roadway are blocked.

For example, assume a situation in which a multi-vehicle crash has blocked all of the north-bound traffic in a place where no side access is possible, such as in the middle of a long bridge. The first official to observe the scene identifies the number of the first barrier module north of the crash site and either by notifying a control center (not shown) or by using a remote control system (not shown) actuates one or more barrier modules to cause a length of the barrier to shift laterally from one lane line to another.

In this example, if the barrier 56 is erected to provide more northbound lanes than southbound lanes (north-bound peak traffic mode), a segment 144 of the barrier 56 is shifted in an easterly direction into the clear area north of the accident that has blocked all north-bound traffic. Ambulances and other emergency vehicles then are able to come with the south-bound traffic and turn into the space created by shifting the barrier segment 144 eastward across the axial line of the barrier 56 to gain access to disabled vehicles 151–154.

If the barrier 56 is deployed as described above and shown in FIG. 13, the invention permits access to an accident site in the south-bound lanes. It might be necessary to place flares, cones or use some other means of traffic control to merge the innermost north-bound traffic lane one lane to the right. The remainder of the procedure for providing access to the crash site is similar to that described above. Emergency vehicles could come with the north-bound traffic and cross to the westerly side of the barrier 56 through a breach created as described above, but positioned south of the crash scene where there is no traffic.

Another method for providing access to the crash site is to employ standard lane closing procedures, placing all of the barrier south of the crash site in its easterly mode to, but not beyond, the crash site. North-bound traffic is restricted to one less lane without the use of flares, cones or exposed personnel. Traffic flow would be more orderly, and once past the crash site, would resume use of all of the lanes east of the barrier. Emergency crews would at all times be completely protected, and emergency vehicles could exit easily along with the normally flowing north-bound traffic, or south with no traffic at all. Upon departure of the last emergency vehicle, the barrier could be redeployed to its pre-crash mode.

Figure 14:
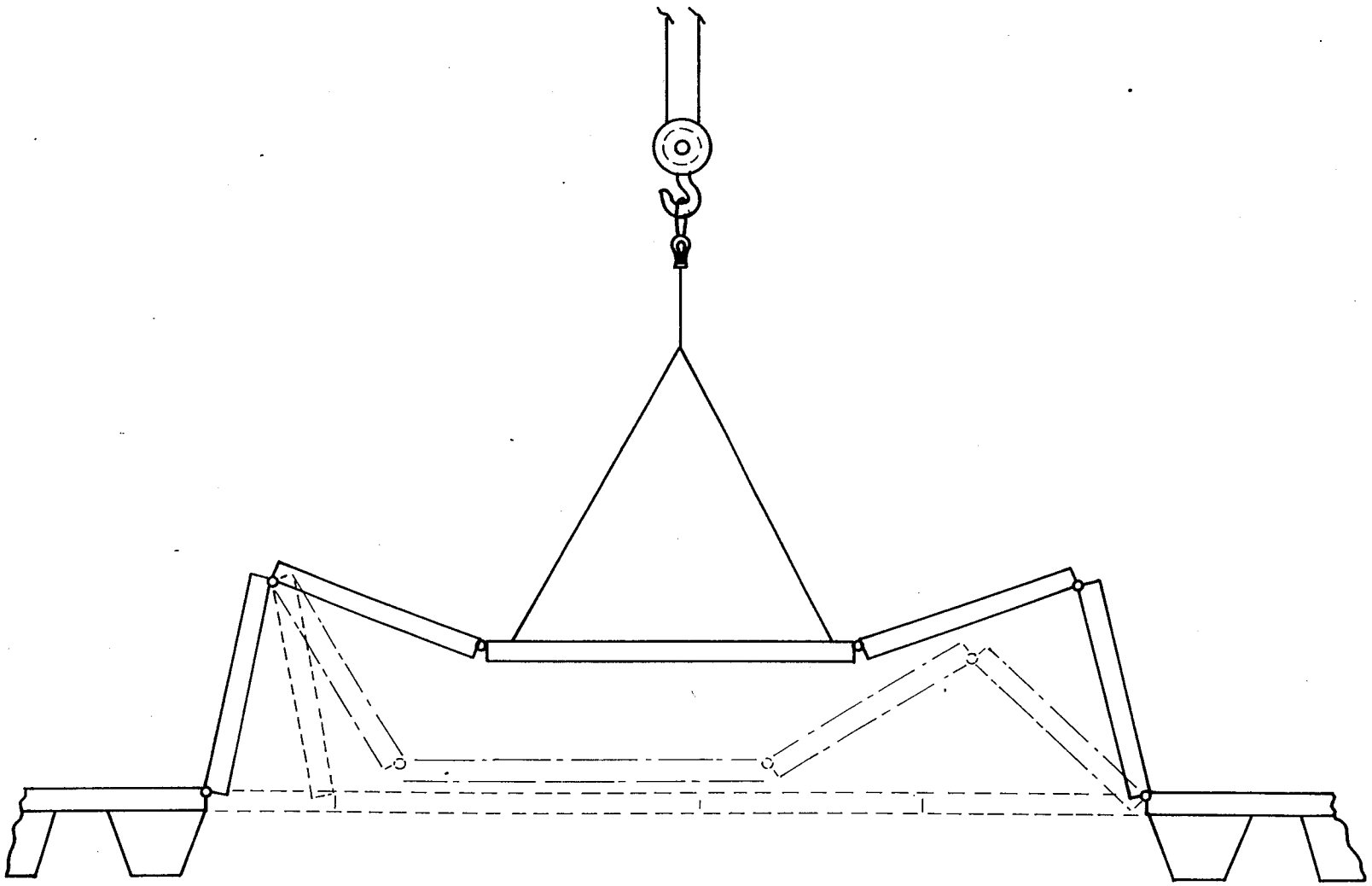
FIG. 14 is an elevational view of a complete movable traffic barrier system hoisted to provide access to the bottom of the barrier and under-roadway systems without disassembly of the barrier.

Referring to FIG. 14, an additional advantage of the present invention is that each set of panels may be lifted in unison to provide access to the roadway subsurface or to other systems (not shown) under the roadway. A pair of lines are shown connected to the roadway panel 26, which is lifted from its normal position. The barrier panels 22, 24, 28 and 30 are lifted with the roadway panel.

The present invention provides an alternating barrier that may be used on both curved and straight roadways. The clearance between successive sections of the barrier along a roadway will easily permit installation and use of the barrier described herein on a curve.

It will be appreciated that modifications may be made from the preferred embodiment described herein without departing from the scope of the invention as defined in the appended claims. Although the preferred embodiment is described with reference to a pair of alternating barriers 56 and 58, the invention also includes a single barrier that may be selectively raised and lowered.

What is claimed is:

1. A barrier for dividing a roadway having a plurality of traffic lanes, comprising:

a plurality of slab-like roadway segments having adjacent sides thereof hingedly joined together; and means for elevating at least two adjacent slab-like segments to form a dividing barrier for separating said traffic lanes in the general form of an inverted "V".

2. The barrier according to claim 1 further comprising means for hingedly mounting a pair of the barrier panels to the roadway.

3. The barrier according to claim 1, wherein the hinges lock to provide rigidity to the first and second barriers.

4. The barrier according to claim 3, wherein the hinges have an unlocked position for each barrier panel to permit removal thereof from the array.

5. The barrier according to claim 1, further comprising support beam means connected to selected hinges, the support beam means depending from the selected hinges to provide vertical support to the panel.

6. The barrier according to claim 5, further comprising a flange extending from the support beam to rest upon a base when the hinge connected to the support beam is in its lower position and to hang between the panels connected to the hinge when the hinge is in its upper position to limit the range of hinging movement of the elevated panels.

7. A collapsible barrier for selectively dividing a roadway, comprising:

a plurality of barrier panels configured to be a section of a roadway and positioned in a side-by-side array between or adjacent other roadway sections;

a plurality of hinges arranged for hingedly connecting adjacent barrier panels together;

means for selectively elevating a first one of the hinges to erect a first barrier comprising a first barrier panel connected to the first hinge and a second barrier panel connected to the first hinge, the first barrier being adjacent a first side of the roadway and providing a traffic lane over the array adjacent a second side of the roadway; and means for selectively elevating a second one of the hinges to remove the first barrier and to erect a second barrier comprising a third barrier panel connected to the second hinge and a fourth barrier panel connected to the second hinge, the second barrier being adjacent the second side of the roadway and providing a traffic lane over the array adjacent the first side of the roadway.

8. The barrier according to claim 7 wherein the means for selectively elevating the first hinge comprises means placed under one of the first and second barrier panels for lifting the first hinge to elevate the first and second barrier panels.

9. The barrier according to claim 8 wherein the means placed under one of the first and second barrier panels comprises a hydraulic jack.

10. The barrier according to claim 8 wherein the means for selectively elevating the first hinge further comprises actuator means having a first end fixed under the roadway and a second end connected to the array for selectively moving the array laterally with respect to the roadway to erect one of the first and second barriers and remove the other barrier.

11. The barrier according to claim 10 wherein the actuator means comprises a hydraulic ram.

12. A movable barrier for selectively dividing a roadway having a multiplicity of traffic lanes, comprising:

a plurality of barrier sections, each barrier section including a plurality of barrier panels positioned in a side-by-side array, the barrier sections being arranged such that each barrier section is between two spaced apart roadway sections;

a plurality of hinges arranged for hingedly connecting adjacent barrier panels together in each barrier section;

means in each barrier section for selectively elevating a first one of the hinges to erect a first barrier comprising a first barrier panel connected to the first hinge and a second barrier panel connected to the first hinge, the first barrier being being between a pair of adjacent traffic lanes of the roadway and providing a traffic lane over the array adjacent a second side of the roadway; and means in each barrier section for selectively elevating a second one of the hinges to remove the first barrier and to erect a second barrier comprising a third barrier panel connected to the second hinge and a fourth barrier panel connected to the second hinge, the second barrier being spaced apart from the location of the first barrier such that at least one traffic lane is formed over each barrier section between the locations of the first and second barriers.

13. A collapsible barrier for selectively dividing a roadway having a plurality of traffic lanes, comprising:

a plurality of barrier panels configured to be a section of a roadway and positioned in a side-by-side array between or adjacent other roadway sections;

a plurality of hinges arranged for hingedly connecting a pair of adjacent barrier panels together;

means for selectively elevating a pair of barrier panels to erect a dividing barrier for separating said traffic lanes comprising a first barrier panel and a second barrier panel.

14. A barrier for selectively dividing a roadway, comprising:

a plurality of barrier panels configured to be positioned between a pair of roadway sections;

means for hingedly connecting adjacent barrier panels together;

means for selectively elevating two adjacent barrier panels to form a first barrier adjacent a first side of the roadway and to provide a traffic lane adjacent a second side of the roadway; and means for selectively elevating a second pair of barrier panels to form a second barrier and to remove the first barrier, the second barrier being adjacent the second side of the roadway and providing a traffic lane over the array adjacent the first side of the roadway.

15. The barrier according to claim 14 further comprising means for hingedly mounting a pair of the barrier panels to the roadway.

16. The barrier according to claim 14, wherein the hinged connecting means lock to provide rigidity to the first and second barriers.

17. The barrier according to claim 16, wherein the hinged connecting means have an unlocked position for each barrier panel to permit disconnection thereof from adjacent barriers.

18. The barrier according to claim 14 wherein the means for selectively elevating the first of barrier panels comprises means placed under one of the first and second barrier panels for lifting the first hinged connecting means to elevate the first and second barrier panels.

19. The barrier according to claim 18 wherein the means placed under one of the first and second barrier panels comprises a hydraulic jack.

20. The barrier according to claim 18 wherein the means for selectively elevating the first pair of barrier panels further comprises actuator means having a first end fixed under the roadway and a second end connected to the array for selectively moving the array laterally with respect to the roadway to erect one of the first and second barriers and remove the other barrier.

21. The barrier according to claim 20 wherein the actuator means comprises a hydraulic ram.

22. The barrier according to claim 21, further comprising support beam means connected to selected hinged connecting means, the support beam means depending from the selected hinged connecting means to provide vertical support to the barrier panels connected thereto.

23. The barrier of claim 22 wherein the support beam means further comprises a flange extending therefrom to provide vertical support to the barrier panels and to limit the range of hinging motion of barrier panels connected to the selected hinged connecting means.

24. A method for selectively dividing a roadway, comprising the steps of:

placing a plurality of barrier panels between a pair of roadway sections;

connecting adjacent barrier panels hingedly together;

selectively elevating adjacent sides of two adjacent the barrier panels to form a first barrier adjacent a first side of the roadway and to provide a traffic lane adjacent a second side of the roadway; and selectively elevating adjacent sides of a second pair of the barrier panels to form a second barrier and to remove the first barrier, the second barrier being adjacent the second side of the roadway and to provide a traffic lane over the array adjacent the first side of the roadway.

25. The method according to claim 24 further comprising the step of hingedly mounting a pair of the barrier panels to the roadway.

26. The method according to claim 25, wherein the hinged connecting means lock to provide rigidity to the first and second barriers.

27. The method according to claim 25, further comprising the step of forming the hinged connecting means to have an unlocked position for each barrier panel to permit disconnection thereof from adjacent panels.

28. The method according to claim 24 wherein the step of selectively elevating the first pair of barrier panel comprises activating a jack placed under one of the first and second barrier panels for lifting the first hinged connecting means to elevate the first and second barrier panels.

29. The method according to claim 28 wherein the step of selectively elevating the first pair of barrier panels further comprises the step of achieving actuator means having a first end fixed under the roadway and a second end connected to the array for selectively moving the array laterally with respect to the roadway to erect one of the first and second barriers and remove the other barrier.

30. The method according to claim 24, further comprising the step of connecting deck rib means to selected hinged connecting means such that the deck rib means depends from the selected hinged connecting means to provide vertical support to the barrier panels.

31. The method of claim 30, further comprising the step of forming a flange on the deck rib means for supporting the barrier panels and limiting the range of hinging motion of the pair of barrier panels that form the erect barrier.

* * * * *